US008227721B2

(12) United States Patent
Piccoz et al.

(10) Patent No.: US 8,227,721 B2
(45) Date of Patent: Jul. 24, 2012

(54) POWER LINE CURRENT INTERRUPTER HAVING A VACUUM SWITCH CHAMBER

(75) Inventors: Daniel Piccoz, Lucenay (FR); Floriane Decq, Macon (FR); Patrice Grosjean, Varennes-St-Sauveur (FR)

(73) Assignee: Areva T & D SAS, Paris la Defense Cedex (FR)

( * ) Notice: Subject to any disclaimer, the term of this patent is extended or adjusted under 35 U.S.C. 154(b) by 294 days.

(21) Appl. No.: 12/603,095

(22) Filed: Oct. 21, 2009

(65) Prior Publication Data

US 2010/0102035 A1 Apr. 29, 2010

(30) Foreign Application Priority Data

Oct. 29, 2008 (FR) ..... 08 57373

(51) Int. Cl.
*H01H 33/02* (2006.01)

(52) U.S. Cl. ..... 218/140; 218/120

(58) Field of Classification Search ..... 218/7–14, 218/118–121, 140, 153, 154
See application file for complete search history.

(56) References Cited

U.S. PATENT DOCUMENTS

| | | | | |
|---|---|---|---|---|
| 6,865,072 | B2 * | 3/2005 | Sato et al. | 361/619 |
| 7,211,761 | B2 * | 5/2007 | Vaghini et | 218/7 |
| 2008/0217153 | A1 * | 9/2008 | Bottcher et al. | 200/48 R |

FOREIGN PATENT DOCUMENTS

| | | | |
|---|---|---|---|
| EP | 1416503 | A2 | 5/2004 |
| EP | 1939909 | A2 | 7/2008 |
| WO | 2006074975 | A1 | 7/2006 |

OTHER PUBLICATIONS

European Search Report for Appl. No. EP 09174001 dated Feb. 8, 2010.

* cited by examiner

*Primary Examiner* — Amy Cohen Johnson
*Assistant Examiner* — Marina Fishman
(74) *Attorney, Agent, or Firm* — Pearne & Gordon LLP

(57) ABSTRACT

This interrupter device includes a parallel branch (4) in which a vacuum switch chamber is connected for breaking current. The branch is inactive in normal operation, with current flowing in it only when the disconnector (2) has started its opening movement, by progressive transfer of the current from the main power line (1) to the branch (4). Since the vacuum switch (6) is generally at rest, it no longer needs to be dimensioned to satisfy stringent electrical and dielectric requirements for normal operation.

5 Claims, 6 Drawing Sheets

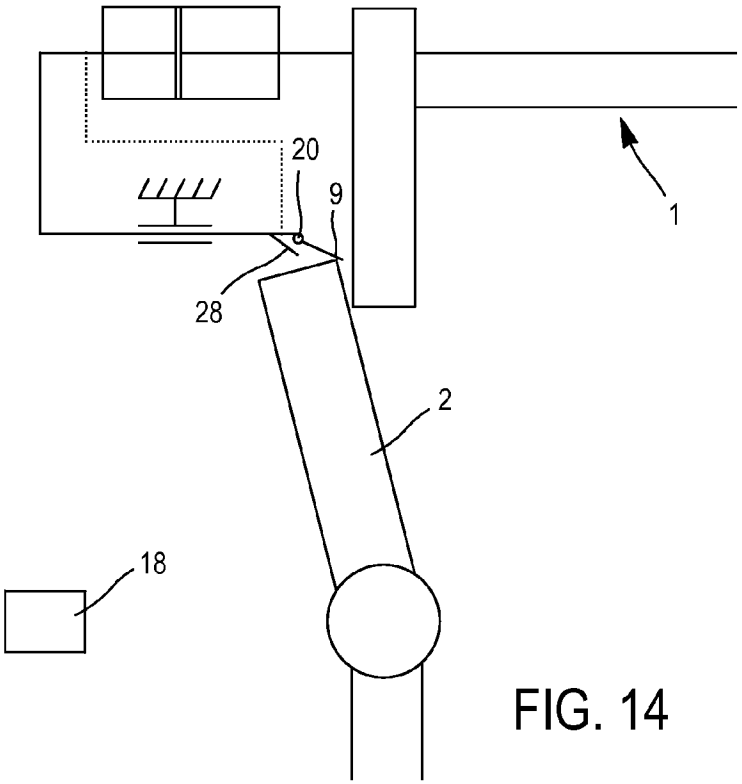
FIG. 14
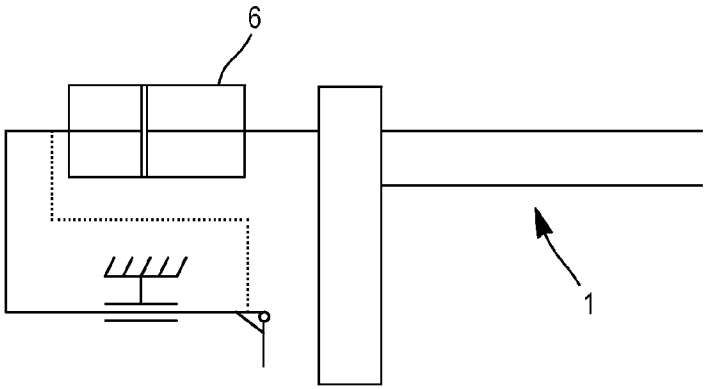
FIG. 13
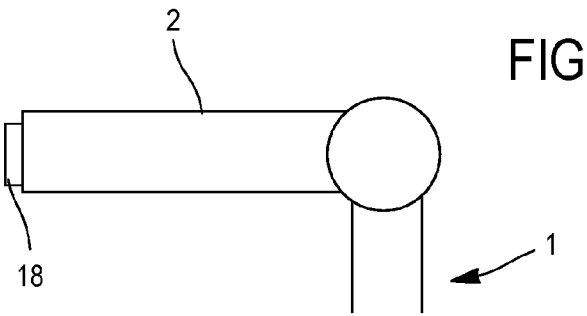

POWER LINE CURRENT INTERRUPTER HAVING A VACUUM SWITCH CHAMBER

BACKGROUND OF THE INVENTION

1. Field of the Invention

This invention relates to a power line (or power cable) current interrupter having a vacuum switch chamber.

2. Description Of The Related Art

Interrupters and circuit breakers in medium or high voltage power lines or cables often include casings in which the switch contacts are housed for relative movement between a position in contact with each other, corresponding to the power line being closed, and a position spaced apart from each other, corresponding to the line being open. These casings are filled with a dielectric fluid in which the switch contacts are immersed, and that assists current breaking by extinguishing the arc that might remain after the switch contacts have separated from each other. Many different fluids (such as air, oil, nitrogen, etc.) have been proposed in the past, but nowadays it is common to use sulfur hexafluoride ($SF_6$), which has good dielectric properties and is therefore well adapted for this purpose. Even so, the use of that gas needs to be limited, because it has the drawbacks that its decomposition products are toxic and corrosive, and it contributes to the greenhouse effect. Accordingly, there may be an incentive to use vacuum switch chambers, which are also employed in some circuit breakers, the switch contacts being internal components of these chambers, which are also most effective in quenching arcing currents; however, their use in today's interrupters cannot be considered without further modification for reasons of cost, because the vacuum switch chambers that would need to be employed in these interrupters would be too burdensome in terms of the materials and dimensions that would have to be adopted in order that they could satisfy various electrical and dielectric requirements, such as the ability to withstand lightning strikes.

BRIEF SUMMARY

The object of the invention is to make the use of vacuum switch chambers economically viable for interrupters. According to an essential aspect, the invention provides a power line (or cable) current interrupter including a vacuum switch chamber having two switch contacts arranged for relative movement between them and able to assume a closed position and an open position, which interrupter is characterized in that it comprises:

- a movable disconnector connected in the power line and adapted to perform a stroke of its movement in which it can assume a line-closed position and a line-open position; and
- a branch connected to the power line at one end of the branch, the vacuum switch chamber being connected in said branch, the switch chamber being operated by a movable part disposed between the vacuum switch chamber and a second end of the branch; and
- in that the disconnector and the movable part are arranged in such a way that the disconnector touches said second end during a portion of the stroke intermediate between the line-closed position and the line-open position, and in such a way that the movable part is arranged to have a first state in which it becomes mechanically separated from the vacuum switch chamber and a second state in which it actuates one of the switch contacts of the vacuum switch chamber so as to produce the open position of the switch contacts.

The essential characteristics of the invention can be summarized as follows: the vacuum switch chamber is not situated on the main power line (in series with the interrupter) that is being switched, but on a parallel branch thereof; the branch is live, with current passing through it only in the instants just before a current is broken, leaving the switch chamber at rest in normal operation, which makes it possible to impose less strict requirements for the switch chamber, such that the switch chamber no longer needs to have so many features; and the movement of the disconnector itself establishes the current flow through the branch while it is performing its stroke to open the power line.

BRIEF DESCRIPTION OF THE DRAWINGS

Other aspects, features and advantages of the invention is described with reference to the accompanying drawings, in which:

FIGS. 9, 10, 11, 12, 13 and 14, are analogous to FIGS. 1 to 6, and show several successive states of another possible embodiment of the device.

DETAILED DESCRIPTION

Figure 1:
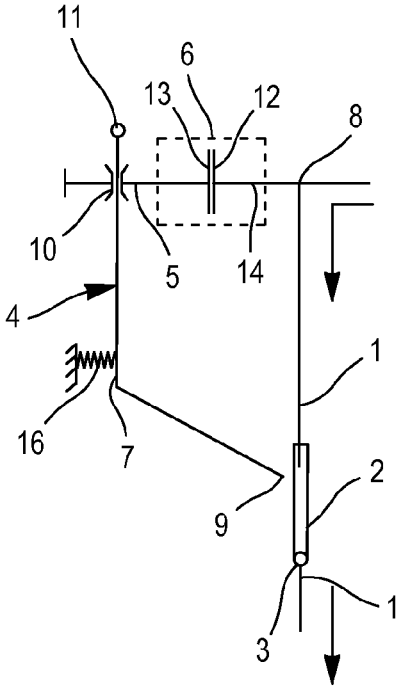
FIGS. 1, 2, 3, 4, 5 and 6 show diagrammatically several successive states of the device during operations to open the circuit and then to close it.

The description begins with those figures of the drawings that explain how the interrupter works. FIG. 1 shows a line 1 that is a main power transmission line, on which a disconnector 2 is situated, this disconnector being adapted to close, or open, in rotation about a pivot 3. The device also includes a parallel branch 4 that consists of a stationary part 5, in which a vacuum switch chamber 6 is connected, and a movable part 7. The stationary part 5 includes a first end 8 of the branch 4, which is connected to the power line 1; the movable part 7 includes a second end 9 (the opposite end from the end 8) of the branch 4, the second end 9 being, when in the position shown in FIG. 1, close to the power line 1 and the disconnector 2, but separated from them. The stationary part 5 and movable part 7 are in electrical continuity with each other, and are hinged together at a junction 10. The movable part 7 is rotatable about a stationary pivot 11. The vacuum switch chamber 6 contains a pair of switch contacts 12 and 13, of which the first contact 12 is carried by a stationary rod 14 that extends to the first end 8 of the branch, while the second contact 13 is carried by a movable rod 15 that extends to the junction 10. Springs 16 extend from a point fastened to the movable part 7 for biasing the part 7 towards the position shown, and the pressure difference causes the rod 15 to hold the vacuum switch chamber 6 closed (by putting the switch contact 13 in its closed position). In this state of the device, in which the disconnector closes the power line 1, current passes freely through the line, but not through the branch 4 in spite of the fact that the vacuum switch chamber 6 is closed.

Opening of the power line 1 is controlled by pivoting the disconnector 2. The device is then in the state shown in FIG. 2, in which the disconnector is touching the second end 9 of the branch 4 and closes it, thereby enabling current to flow in the branch 4. The main power line 1 does however remain closed, so that the transfer of the current to the branch 4 is progressive. The pivoting movement of the disconnector 2 is ended by the opening of the power line 1, as is shown in FIG. 3. Said pivoting movement also moves the movable part 7 of the branch about the pivot 11 (this may take place starting from the state shown in FIG. 2). The vacuum switch chamber 6 remains closed, so that the current is then entirely switched into the branch 4, and as a result no arc is struck, when the disconnector leaves the power line 1.

Figure 3:
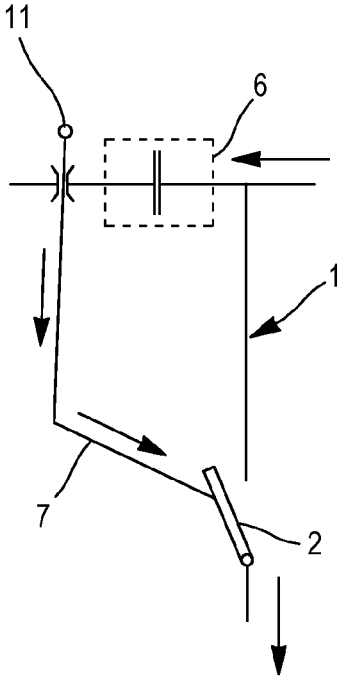
Figure 4:
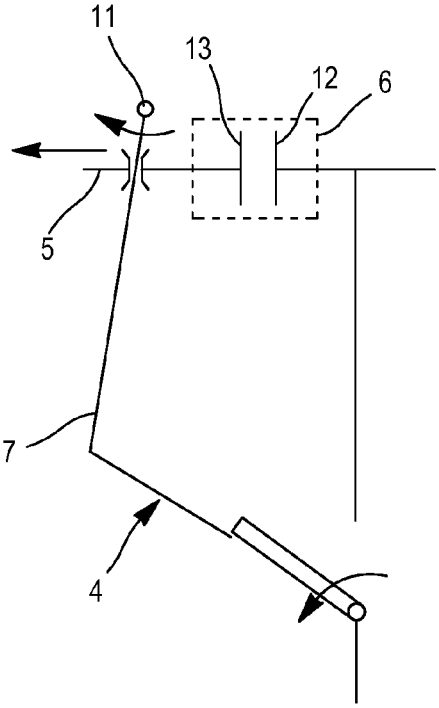

The vacuum switch chamber 6 is opened when the distance traveled by the movement of the disconnector 2 becomes longer, with the movable part 7 of the branch causing the rod 15 to move so as to open the switch contacts 12 and 13, this situation being shown in FIG. 4. Since the vacuum switch chamber 6 is open, current is no longer flowing either in the branch 4 or in the main power line 1: breaking of the circuit is therefore complete. The vacuum switch chamber 6 has been subjected to current flow briefly in the states shown in FIGS. 2 and 3, but not in the stable operating state shown in FIG. 1.

Figure 5:
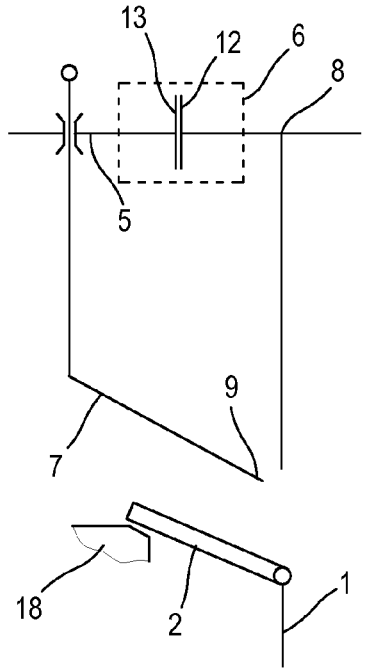

As the pivoting movement of the disconnector 2 is continued, the device reaches the state shown in FIG. 5, in which the disconnector has escaped from contact with the second end 9 of the movable part 7, which is therefore now free. The return springs 16 then restore the movable part 7 to its initial position, and the vacuum switch chamber 6 is closed, again by operation of the pressure difference. The branch 4 has thus been brought to the same potential as the power line 1 on the side of the first end 8. The disconnector 2 is far enough away from the branch 4 to prevent any arc being struck. It may be in engagement against a ground contact 18, so as to ensure grounding of the voltage on the power line 1.

Figure 6:
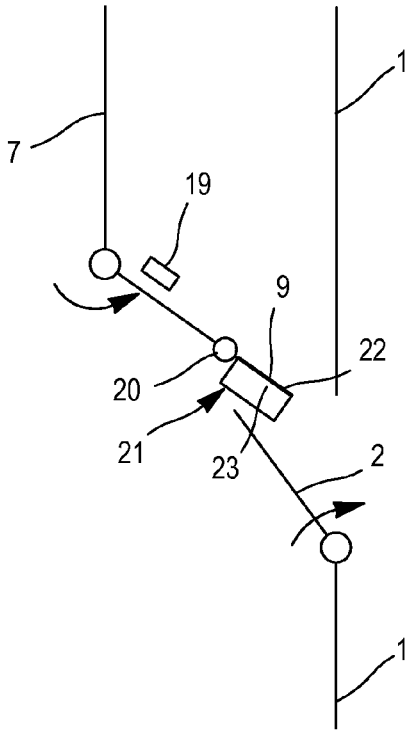

Reclosing of the power line 1 is achieved by pivoting movement of the disconnector 2 in the reverse direction in accordance with the following procedure shown in FIG. 6. The movable part 7 is maintained in the state shown in FIGS. 1 and 5 by contact with a stationary stop 19 and by the springs 16, while the second end 9 is coupled to the remainder of the movable part 7 of the branch through a pivot 20. This pivot 20 is equipped with a stop element that arrests its movement in the opening direction, together with a spring that biases it towards the stop position. It is therefore unidirectional: the second end 9 is moved with the remainder of the movable part 7 so long as the disconnector 2 is being moved in the direction for opening the power line 1, as shown in FIGS. 1 to 5 (i.e. in the anti-clockwise direction), the stationary stop being operative, but it is able to be moved without movement of the remainder of the movable part 7 when the disconnector 2 is closing the power line 1 in the opposite (clockwise) direction shown in FIG. 6. The disconnector 2 can then revert to the starting position shown in FIG. 1 by moving only the second end 9, without moving the remainder of the movable part 7, and therefore without either acting on the vacuum switch chamber 6 or causing any contact to be made between the line 1 and branch 4, this being achieved in the following way. FIG. 6 indicates an insulating layer 21 applied on a second face 23 of the second end 9, opposite to its first face 22, that has a conductive coating and that faces towards the power line 1, the disconnector 2 engaging frictionally on the insulated second face 23 during the opening of the line 1.

Figure 8:
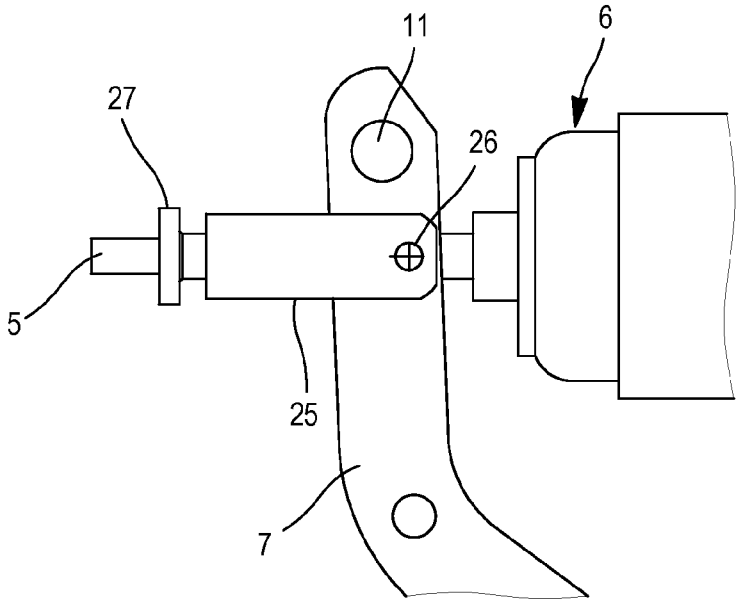
FIGS. 7 and 8 show a practical embodiment of the device in two different views.
Figure 7:
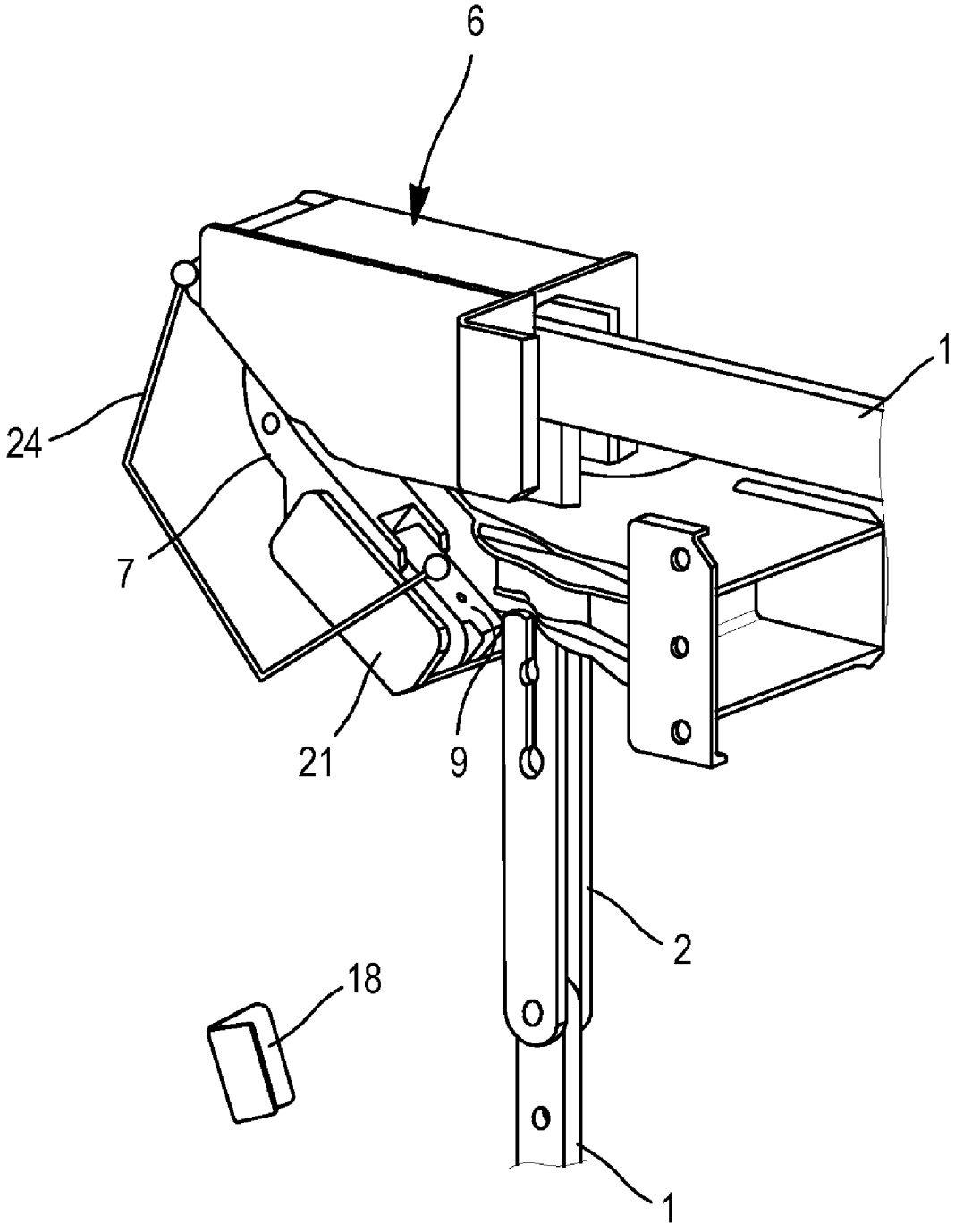

FIGS. 7 and 8 show the construction of one possible embodiment of the invention. There can be seen some of the above-described components, which do not need describing again. But it is useful to describe some of them. Thus the movable part 7 is not itself conductive. It is provided with a cord or braid 24 that extends from the movable rod 15 to the second end 9, avoiding the pivot 20. The cord or braid 24 is flexible and conductive. The insulating layer 21 may be formed in one piece, clamped around the second end 9 and straddling the movable part 7. In addition, it is convenient to provide a link 25, hinged to the movable part 7 and sliding on the movable rod 15, so that the movable part 7 can move the rod 15, the link 25 being, both in the starting position shown in FIG. 1 and in the position shown in FIG. 8, separated from a collar 37 at the end of the rod 15 by a clearance that delays the transition from the state shown in FIG. 2 to that in FIG. 4. The movement of the rod 15 begins once this clearance has been taken up by the line 25 meeting the collar 37.

A second embodiment is described below with reference to FIGS. 9 to 14, which show some steps in its operation. The interrupter shown here differs from that described above in that the movable part (which here has the reference 27) of the branch (which here has the reference 26) is arranged for sliding movement as well as turning movement, the other elements of the interrupter being unchanged and carrying the same references as before. The moveable part 27 accordingly has a slider 28 parallel to the axis of the vacuum switch chamber 6, the slider being movable in linear motion in a stationary slide guide 29. A second end 9 of the branch 26 is again shown, being adjacent to the disconnector 2 in the starting position, this end being coated with a conductive layer on its first face 22 facing towards the disconnector, and with an insulator on its opposite face 23. The second end 9 is coupled to the slider 28 by the pivot 20.

Figure 9:
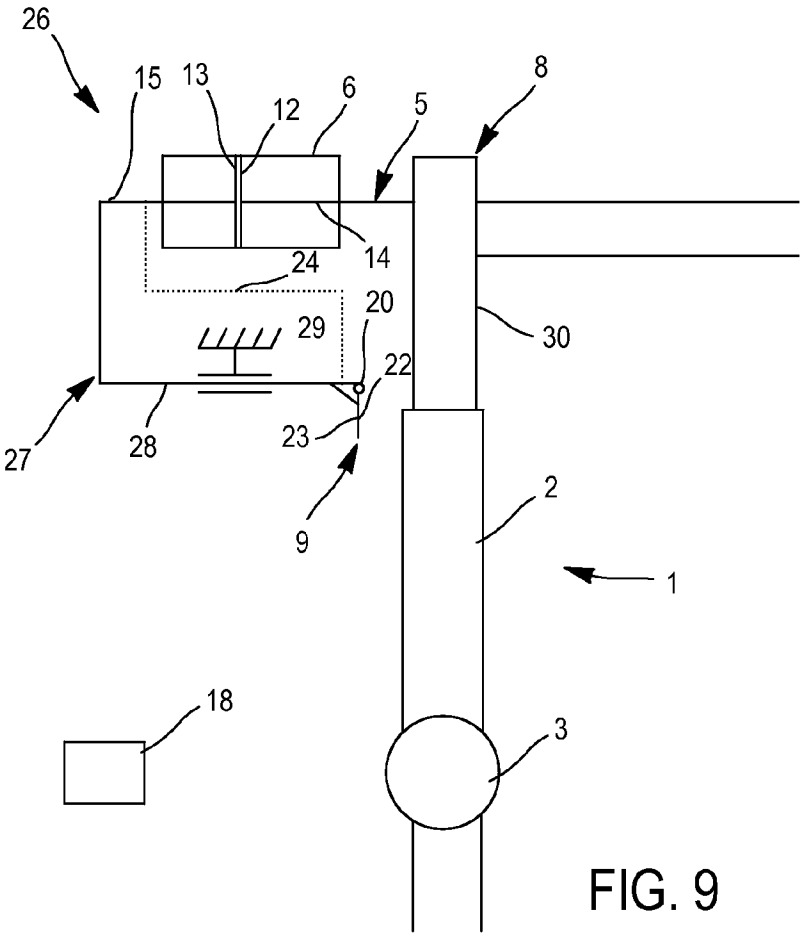

In the state shown in FIG. 9, the power line 1 is closed by the disconnector 2. The vacuum switch chamber 6 is closed, its contacts 12 and 13 being engaged together, but no current is passing through the branch 26.

Figure 2:
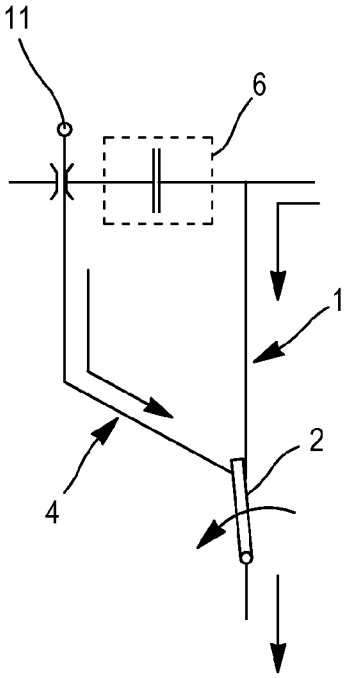
Figure 10:
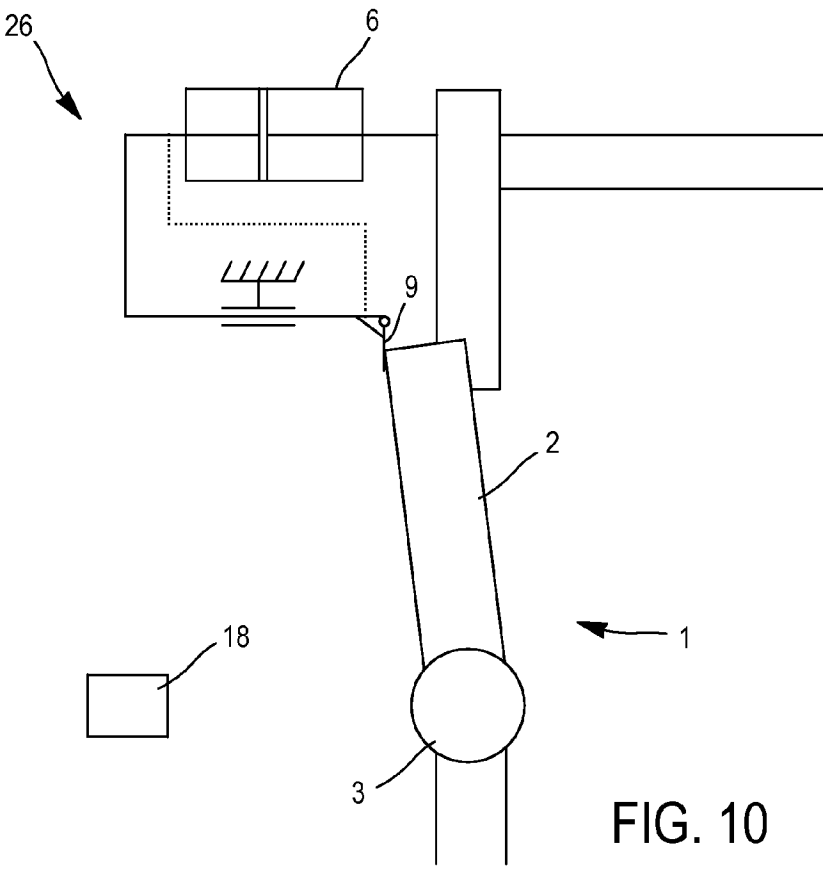

The state shown in the next figure, FIG. 10, corresponds to that of FIG. 2: the disconnector is in contact with the second end 9 without having gone out of contact with the busbar, 30, of the power line 1. The current is also flowing through the branch 26. The vacuum switch chamber 6 remains closed by means of a device for delaying opening, such as the device described above, having the pivoted link 25 (that is not shown here).

Figure 11:
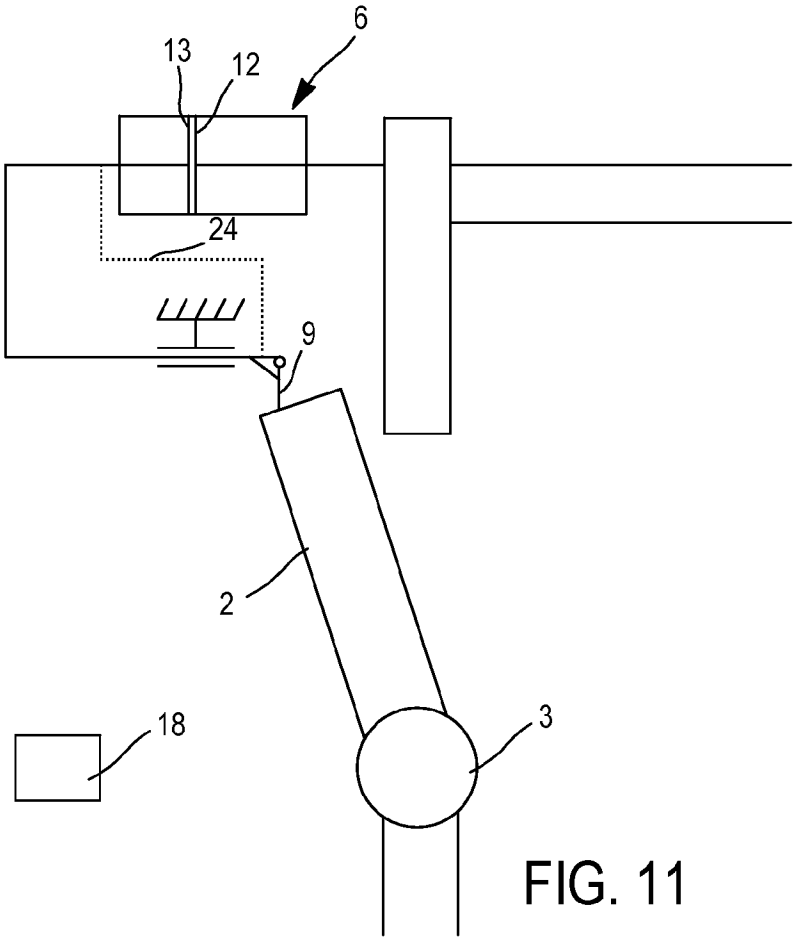

The state shown in the next figure, FIG. 11, corresponds to that shown in FIG. 3: the disconnector 2 is no longer in engagement with the busbar 30, and has transferred the current in the power line 1 to the branch 26, though it remains in contact with the second end 9, which it is pushing so that the movable part 27 is sliding in the slide guide 29. The contacts 12 and 13 are separated, which also opens the branch 26. The vacuum switch chamber 6 acts to extinguish the arc.

Figure 12:
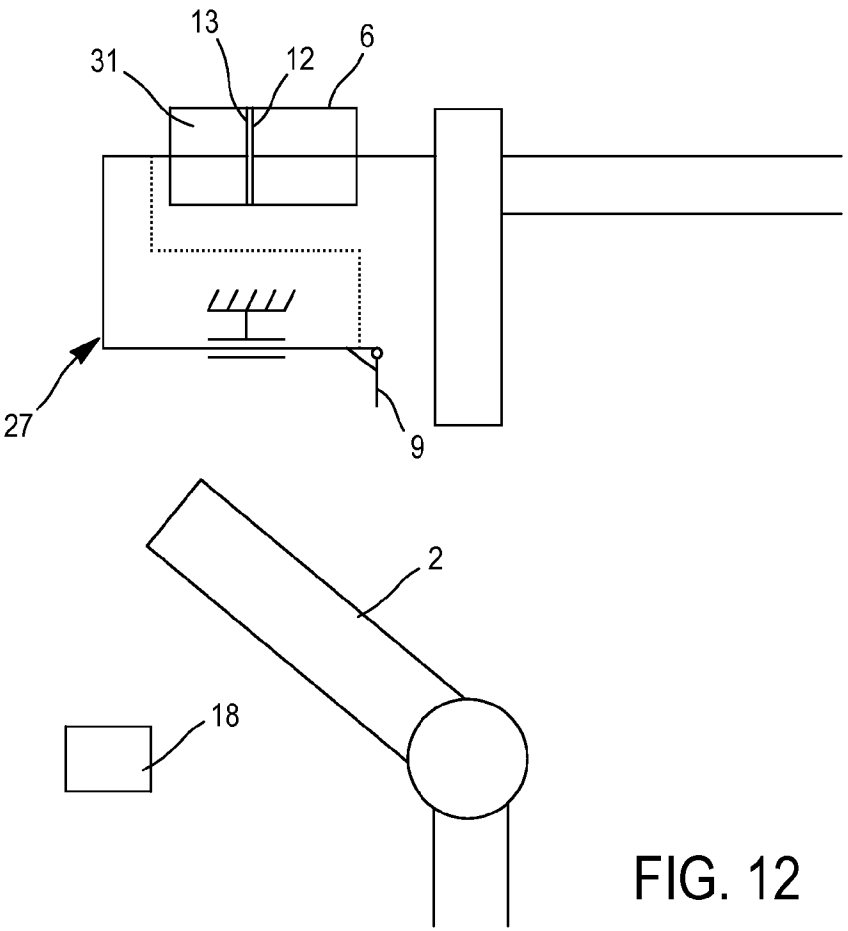

FIG. 12 shows a state in which the disconnector has left the second end 9 behind, which enables the movable part 27 to be returned and the vacuum switch chamber to be reclosed. This is achieved by the pressure difference acting like a return spring.

FIG. 13 shows that, as in FIG. 5 above, the disconnector 2 may be located on a ground contact 18, the lower part of the line 1 being then put at ground potential, while the whole of the branch 26 is at the same voltage as the upper part of the power line 1 because the vacuum switch chamber 6 is closed.

FIG. 14 is similar to FIG. 6 and shows the closing of the interrupter: the disconnector 2 passes the second end 9 by causing it to turn on the pivot 20. Because it is sliding on the surface 23 having its insulating coating, the disconnector does not set up any current path through the branch 26 from the power line 1, but recloses the line 1 once it has touched the busbar 30. This brings the system back to the state shown in FIG. 9. The second end 9 has escaped and returns to its initial equilibrium position.

The invention claimed is:

1. A power line or power cable current interrupter including a vacuum switch chamber (6) having two switch contacts (12, 13) arranged for relative movement between them and able to assume a closed position and an open position, which interrupter comprises:

a movable disconnector (2) connected in the power line and adapted to assume a line-closed position (1) and a line-open position during a stroke of the movable disconnector's movement; and a branch (4) connected to the power line at a first end (8) of the branch, the vacuum switch chamber being connected in said branch, the branch including a movable part (7) disposed between the vacuum switch chamber and a second end (9) of the branch opposite to the branch's first end; and in that the disconnector (2) and the movable part are arranged in such a way that the disconnector touches said second end (9) during a portion of the stroke intermediate between the line-closed position and the line-open position, and in such a way that the movable part is arranged to have a first state in which the movable part is disengaged from the vacuum switch chamber and a second state in which the movable part actuates one of the switch contacts (13) of the vacuum switch chamber so as to produce the open position of the switch contacts, wherein said second end has an electrically conductive first face (22) that faces towards the power line (1), and an insulating second face, and in that the disconnector (2) is movable in alternate directions, and wherein said second end is connected to another portion of the movable part by means of a pivot (20) for movement in one direction, said pivot having an end stop and a return spring and being adapted to be moved and retracted when the alternately movable disconnector (2) is being moved in said stroke from the open position of the power line to the closed position of the power line.

2. An interrupter according to claim 1, further comprising a return spring (16) for returning the movable part to a position in which said second end (9) is close to the power line (1).

3. An interrupter according to claim 1, wherein the disconnector (2) is pivoted.

4. An interrupter according to claim 1, wherein said movable part (7) is pivoted.

5. An interrupter according to claim 1, wherein said movable part is arranged for sliding movement.

* * * * *